US008256538B1

(12) United States Patent
Deslierres et al.

(10) Patent No.: US 8,256,538 B1
(45) Date of Patent: Sep. 4, 2012

(54) CONTAINMENT SYSTEM FOR OIL FIELD RISER PIPES

(76) Inventors: John Mayn Deslierres, Fullerton, CA (US); Maria R. Cabedo-Deslierres, Fullerton, CA (US)

( * ) Notice: Subject to any disclaimer, the term of this patent is extended or adjusted under 35 U.S.C. 154(b) by 0 days.

(21) Appl. No.: 13/373,334

(22) Filed: Nov. 10, 2011

(51) Int. Cl.
*E21B 21/10* (2006.01)

(52) U.S. Cl. ..... 175/235; 166/332.1

(58) Field of Classification Search ..... 166/332.1; 175/232, 235, 241, 242
See application file for complete search history.

(56) References Cited

U.S. PATENT DOCUMENTS 7,090,033 B2 * 8/2006 Chan et al. ..... 175/25
* cited by examiner

*Primary Examiner* — Brad Harcourt

(57) ABSTRACT

A riser pipe containment valve attached to the drill string tool that uses the wells' intense pressure to cap and control flow when lowered down the riser and attached to its internal wall. Oil/gas sealing and stoppage flow through the valve are controlled by stop flow plug movement. The valve attached then to the riser pipe wall is locked to that surface with pressure indented balls forced into wall indented cavities locking valve to riser in multiple engagement points. When the valve is installed as a riser pipe insert, and used as a by-pass stop flow pipe, without retention attachments, it continues to function as an oil/gas stop flow plug system, and electronic sensors in the valve are utilized to monitor flow and sealing conditions relative to high pressure and convey data to the drill string tool and its electronic system display.

2 Claims, 5 Drawing Sheets

CONTAINMENT SYSTEM FOR OIL FIELD RISER PIPES

FIELD OF THE INVENTION

This invention relates generally to offshore monitoring and control of oil/gas from new and/or existing wells previously drilled and in the recoverable mode, mainly when out of control and intense pressures are encountered.

THE OBJECT OF THE INVENTION

The object of this invention is to provide an urgent means for stopping and capping oil/gas escaping passage uncontrollably up a riser tube and providing a means to inhibit the tremendous loss of product and its damage to the environment, mainly when other capping procedures fail.

PRIOR ART—REFERENCES CITED—

| | | | |
|---|---|---|---|
| 2,570,372 | Oct. 9, 1951 | Parrish | (137/88) |
| 3,783,887 | Jan. 8, 1974 | Shoji | (137/38) |
| 4,126,183 | Nov. 21, 1978 | Walker | (166/338, 337, 364, 72) |
| 4,813,495 | Mar. 21, 1989 | Leach | (175/6, 166/358, 175/7) |
| 5,727,640 | Mar. 17, 1998 | Gleditsch | (175/7, 166/358) |
| 6,401,823 B1 | Jun. 11, 2002 | Gonzalez et al | (166/319, 321) |
| 6,668,943 B1 | Dec. 30, 2003 | Maus et al | (175/5, 25, 38, 48, 212) |
| 6,802,379 B2 | Oct. 12, 2004 | Dawson et al | (175/38, 70, 206) |
| 2005/0284639 A1 | Dec. 29, 2005 | Reimert | (166/363, 368) |
| 7,121,346 B2 | Oct. 17, 2006 | Wolff et al | (166/348, 368) |
| 2009/0126798 A1 | May 21, 2009 | Mather | (137/12, 188, 489.5) |

BACKGROUND OF THE INVENTION

In the present day operating environment, exploratory development companies operating in their search for new sites to obtain oil in the ocean floor, drill pilot wells at many sub sea sites in search of and to verify that the site has productive capability.

To do this, they need to establish that the oil fields which they are screening can provide oil quantities necessary to establish whether the site is commercially feasible. Thus, they generally find necessary to drill a series of exploratory drill sites to determine the size and magnitude of the field they are working in. The initial operations take care of extracting and eliminating the so called mud, which is the assemblage of drilling fluids and cuttings. This is necessary and they need to determine the problems they would encounter to develop this new oil site, which is accomplished by use of either a drill ship or a movable drill platform that they move over and about the potential exploratory site for pilot drilling of wells. To do this as the operators drill into the ocean floor, they insert a riser pipe in the drill hole as they drill deeper and deeper to find the cavity of oil they are searching for. When they strike a rich quantity of oil, they plug the new well site up and drill new exploratory test holes in the surrounding area of the ocean floor, to determine the magnitude of the oil field that they have found. To prevent loss of oil through these newly drilled exploratory wells, as they finish drilling at each test site, they plug these pilot wells with a mix of cement that is pumped down the riser pipe and generally attempts to seal each test well so that they can return at a later date and redrill at this newly discovered oil source. At this oil source, when the operators are ready to convert it over into a producing well, they have to either drill additional new wells, or drill down through the concrete plug that they had put in the pilot well and had previously capped.

When the work is in shallow depths, the establishment of these test wells presently are plugged using this pump down cement in the riser to stop the flow of oil.

When intense pressure of a well is encountered in the riser, at the riser surface, and the ocean floor site is penetrated, the oil and gas, due to pressure, escape up the well and the operators are forced to quickly cap the well in order not to lose oil and gas under pressure into the ocean and contaminate the ocean water surrounding the new well site.

As the operators expand their locations for these test well sites, they are obliged to move further and further away from land, looking for richer fields of oil on the ocean floor and as they establish these exploratory new wells, at these sites they encounter increased pressure, the deeper they drill and further outward they reach in the ocean. What was feasible originally for the establishment and plugging of these test well sites, in shallow water, has become more difficult when encountering extremely high pressures, and the methods for plugging these wells have become risky and coping with this immense high pressure, is the reason why these previous methods of plugging wells have now been considered dangerous and almost impossible to accomplish. Because of this condition, there have been times when accidents have happened at these well sites resulting in great quantities of oil dispersed in the ocean. In a few occasions, operating personal lost their lives while closing down the well sites.

There is an urgent need for a new method and new equipment to operate and provide a means to capture the oil flow encountered in normal situations or in emergencies at over flowed well sites. The present invention does neither cover any procedures associated with the process of drilling holes in the ocean floor, nor the problems of discharging the fluids and cuttings that are the residue of drilling. This invention plugs the wells' riser after the well has been drilled, by removal of the drill and insertion of this stop flow plug containment system. This invention is a new method and new equipment to operate and provide a means to capture the oil/flow encountered at the test well sites. In fact, the system and the mechanism of this invention do not fight the high pressure of deep seas; on the contrary, such high pressure is used to actuate and close down the valve blocking the escape of precious oil and gas.

In the searches reviewed regarding existing possible conflicting patents, most of the related patents concern primarily the drilling function, which do not apply to the present invention. That is the case of the following patents:

U.S. Pat. No. 6,668,943 B1, of L. Donald Maus et al, for "Method and Apparatus for Controlling Pressure And Detecting Well Control Problems During Drilling of an Offshore Well Using a Gas-Lifted Riser", U.S. Pat. No. 5,184,686, of Gonzalez, for a system to avoid washout, however that system requires using two different size drillings risers.

U.S. Pat. No. 5,727,640, of Svein Gleditsch (Norway), for "Deep Water Slim Drilling System"

U.S. Pat. No. 4,813,495, of Colin P. Leach, for "Method and Apparatus for Deep Water Drilling In turn, we will cite some patents which do not mention expressly in their titles their association to the drilling function but, in fact, they are related thereto, i.e., they are part of the deep ocean well drilling:

U.S. Pat. No. 7,121,346 B2, of Danny K. Wolff et al., for "Intervention Spool for Subsea Use" is a multiplicity of valves in sequence to close-out the flow which is a conventional method of flow control, and that does not apply to the present invention U.S. Pat. No. 6,802,379 B2, of Dawson et al—for "Liquid Lift Method for Drilling Tisers", is a patent related to drilling through the risers below the body of water and injecting fluids into the wells riser, which does not apply to the present invention Pat No. US 2009/0126798 A1, of Sam Mather (GB) for "Autonomous Shut-off Valve System", this system uses a fluid powered valve actuator and multiple pressure sensors to close the flow, which does not apply to the present invention.

Pat. No. US 2005/0284639 A1, of Larry E. Reimert, for "Pressure Compensated Flow Shut-Off Sleeve for Wellhead and Subsea Well Assembly Including Same", where the shut-off function is controlled by a movable sleeve which opens and closes flow ports, which does not apply to the present invention.

U.S. Pat. No. 3,783,887, of Akira Shojl (JP), for "Self-Closing Valve Device in a Piping System of Fluids", that comprises a valve chamber, an inlet pipe for a fluid connected to a control cylinder an outlet pipe that operates a piston by use of a permanent magnet that seals the passage with a globe, and it does not apply to the present invention.

U.S. Pat. No. 2,570,372, of Tom E. Parrish, for "Automatic Shutoff Valve", the operational functions are conducted in the mud at the drilling point of the well and uses a float to shutoff the fluid in the pipe, and this does not apply to the present invention.

U.S. Pat. No. 4,126,183, of Raymond W. Walker for "Offshore Well Apparatus with a Protected Production System", that includes a platform means at the sea surface and a complex well template means beneath the platform means, which does not apply to our invention.

U.S. Pat. No. 6,401,823 B, is a part of the drilling operations to control the mud circulating system in different stages, shutting off the flow with a piston that closes off ports driven by a spring operated piston in a cylinder that opens and closes ports in the valve, and it does not apply to the present invention.

U.S. Pat. No. 4,291,772, of Beynet, for "Deep Water String Shut-Off" which operates controlling the flow of the mud during drilling, using a spring for different drilling conditions, and it does not apply to the present invention.

The system of pumping cement down the riser is next to impossible where well pressures are up in the thousands. A recent well site, where an accident occurred, caused a considerable number of lives lost, because the oil pressure encountered was greater than 5,000 psi. Tremendous quantities of oil leaked out through the riser pipe to the surface of the ocean and could not be captured for a long period of time. As a result, contaminated beaches and vast areas of the ocean suffered a catastrophic ecological disaster. The present new invention has addressed this problem and provides a new method for capping an ocean drilled well site, minimizing the loss of oil into the ocean. To cap a newly drilled well and install its riser pipe, presently the cap function is accomplished up at the surface and as a part of the operation and procedure, must cope with the internal pressures coming up the newly inserted riser pipe. Once drilled into a new site, the riser pipe releases this intense oil and gas pressure that the operator must cope with. In fact, when the pressures are so intense and uncontrollable, sometimes even riser pipe has been bent and cut in order to stop and seal the upward pressure flow. Fighting to suppress the intense pressure of oil and gas coming up the riser pipe, and the urgent need to cap this well riser pipe at the surface, the existing method of pumping fluid cement mix down the riser, in large quantities, to stop and cut off the flow, is well known as very difficult and should be considered not the most efficient way to solve the capping problem.

The present invention addresses the problem differently, aware of the fact that there is an intense unknown quantity of oil and gas that must be quickly contained against high pressure to accomplish a successful capping and cutoff of the volumes of gas and oil escaping into the ocean The present invention uses the pressure available to stop the escaping oil flow and to seal the riser. Applying such logic, this invention is designed to insert in the riser pipe a stoppage plug as a shut off barrier for this oil flow. This invention is a valve assembly attached to the present drill string tool, to be used after all drilling is completed. One or more electronic sensors are contained in the valve in order to monitor the stop flow function and conveys the conditions to an electronic operators' display, for operational control and monitoring.

The present invention accepts the fact that there is unknown volumes and quantities of pressure, and the sealing capping function there must be acknowledged and worked with, so that the flow can be captured and stopped. Since it is there, then the solution of the problem should be reversed and the pressure should be used to help and aid the capping problem The sensor, or sensors, attached to the valve at the end of the drill string tool send data to the operator's remote electronic display panel who will act according to where the oil/flow should be stopped, as well as all pertinent action to be taken.

The drill string tool operation can lower the containment valve and close out the flow with the valve from above, at—or below—the ocean surface. In short, we are closing the well, by plugging the well flow with the well own pressure.

BRIEF SUMMARY OF THE INVENTION

This invention provides a means for stopping all flow of oil/gas that is surging up a newly drilled well. It places a stop flow plug assembly in a valve that provides for flow control and oil/gas stoppage up and through a well riser pipe. It utilizes the intense pressure in the well to activate the plug position and holds the plug for retention of the oil/gas being driven to the surface. It places a valve that is attached to the end of a drill string tool being inserted into a riser already in operation on the well. The valve contains provisions for the operator of the drill string tool to lower the valve into the riser to any location in the well above the subsea tree installed on the new or reinitiated well. The containment system valve provides a stop flow plug and an engagement system that is driven and powered by the internal pressure coming out the well. The pressure drives a family of engagement locking balls that are captured in the valve and locks the balls, that are indented into the riser wall, by use of the high internal well pressure. At the same time, it places the stop flow plug in the closed no flow position in the valve. The valve contains a mechanical linkage means to ensure the family of balls fully lock to the riser. The balls permit the drill string operator to attach the valve and to release the valve from the riser. The operator can open and permit the oil/gas flow to flow completely or stop flow through the valve by the use of the tool extension poste on the end of the drill string tool that engages the containment system. The valve structure contains one or more electronic sensors that enable the drill string operator in the drill ship or platform to monitor and control the positioning of the stop flow containment valve and its internal stop flow position. In addition, the operator controls the procedure and management of placing and locking the valve into the riser. This sensor, or sensors, provides him with a means of monitoring all functions in the stop flow containment system installation and operation.

DETAILED DESCRIPTION OF THE INSTANT INVENTION

Figure 1:
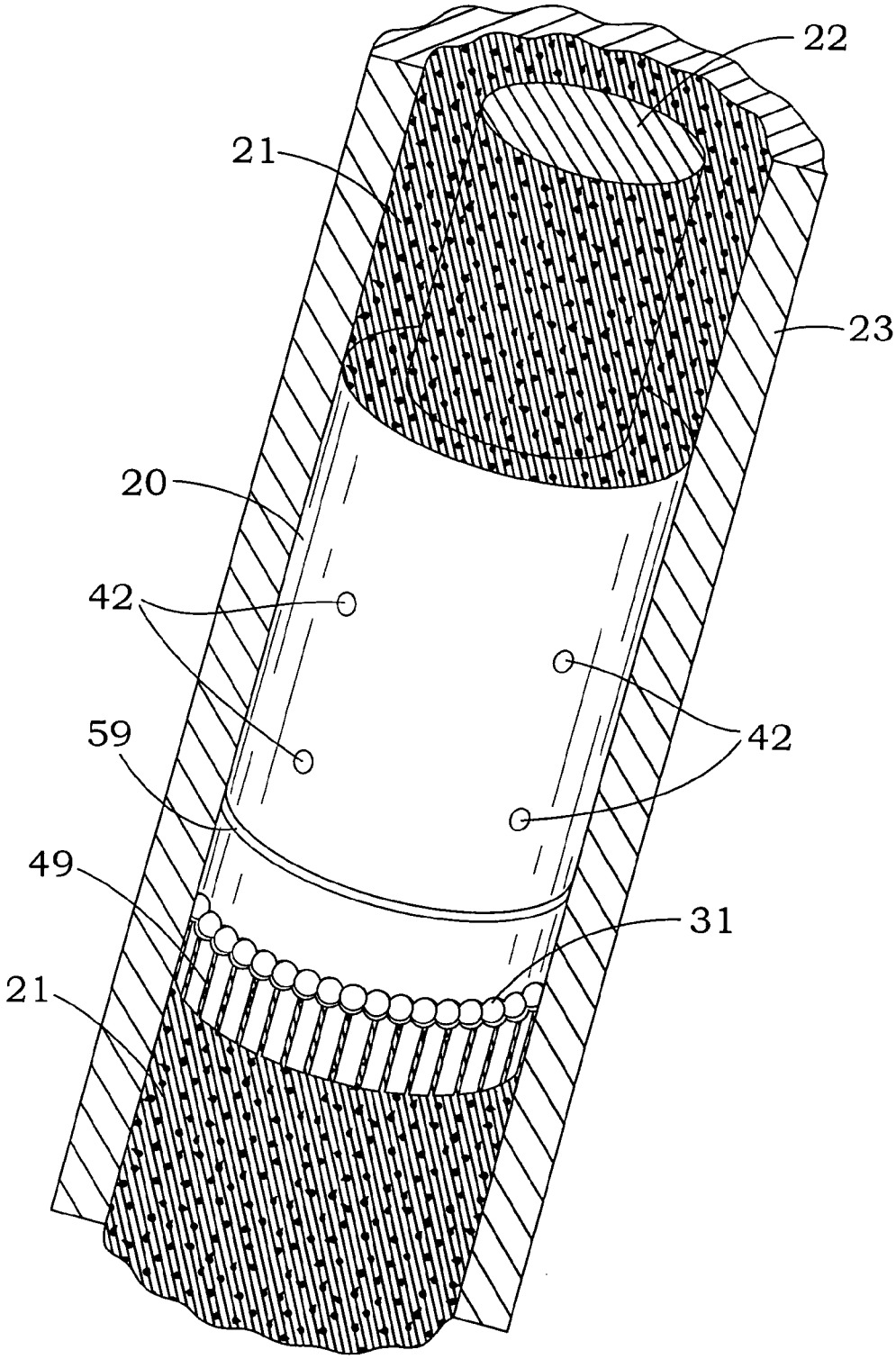
FIG. 1 illustrates the embodiment configuration for oil/gas retention and cutoff of the flow to the surface through a valve in a riser pipe. The illustration shows the containment valve (20) attached to the end of a drill string tool assembly (22) ready to engage the retention system and lock into the internal wall of the riser. It shows the valve already inserted in the riser and ready to be retained there. The family of ball bearings (31) can be seen are contained within the valve envelope but they are not expanded to lock into the riser.
Figure 2:
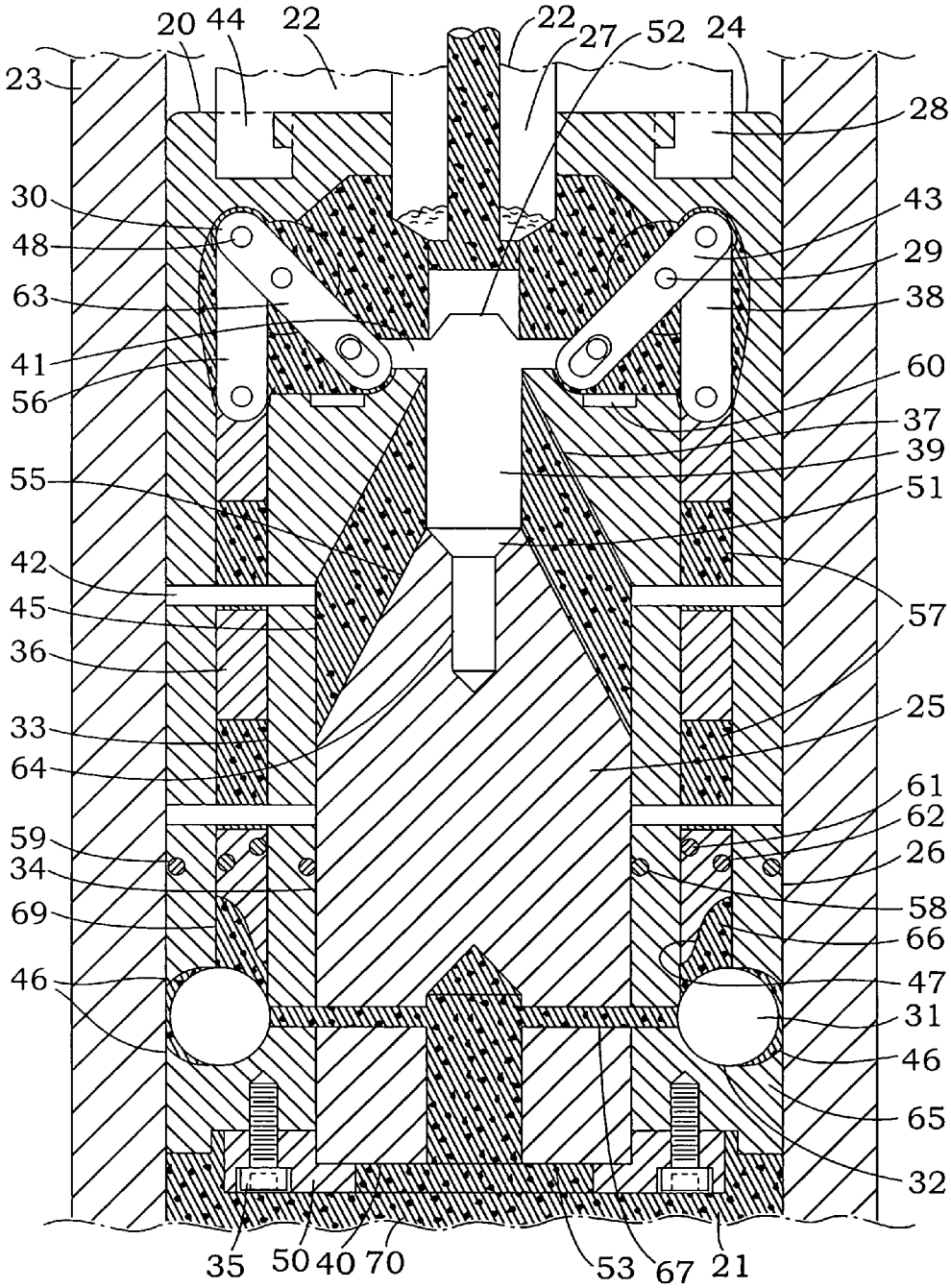
FIG. 2 shows in detail a cross section of the valve with all its components, the valve assembly (24), it shows oil/gas (21) in the assembly as it flows through the valve, a drill string extension tool (27) engaging the upper end of the valve housing structure (26) and a oil gas stop plug (25) in the assembly. The engagement and centering (51) of the tool post adaptor (39) the drill string tool (52) with the tool post adaptor (39). Steel balls (31) are captured in the valve A ball cage (32) is comprised of the internal stop flow plug structure (65) and the outside valve housing structure (26) There are four different O-rings: (58), (59), (61), (62) that seal all leakage paths in the valve. the stopper base (53) functions as a piston drive and its nose coned shaped surface (55) against the cone shaped cavity (37)
Figure 3:
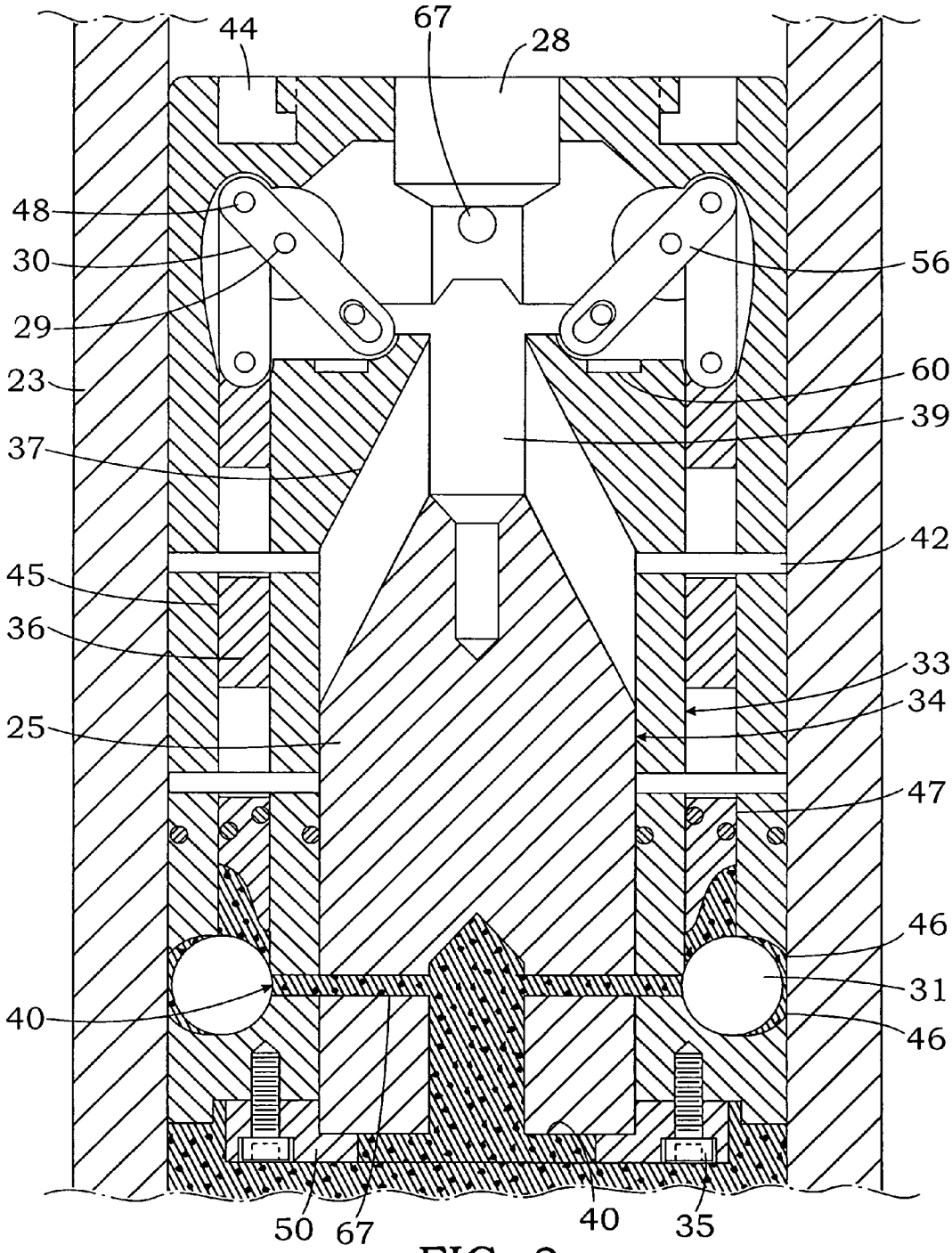
FIG. 3 illustrates how the valve is assembled and how the stop plug is captured in the valve ready for use. A close out plate (50) is attached to two cylindrical guide rails with cap screws (35). In addition, the guide rails are attached to the valve's inner shell structure (45) and ensure that the pressure drives the locking balls full around to lock into the riser wall. Each of these two surfaces, that capture and retain the balls, contains the projecting lips (46) that prevent escape of the balls from the valve and determine the amount of the ball projection into the riser wall to engage and lock into the valve in the riser pipe. The ball wedge (47) is attached to the lower end of the sliding bar which is attached to the mechanical linkage at the opposite end of the sliding bar, driven with the same pressure that moves the flow plug to the stop flow position
Figure 4:
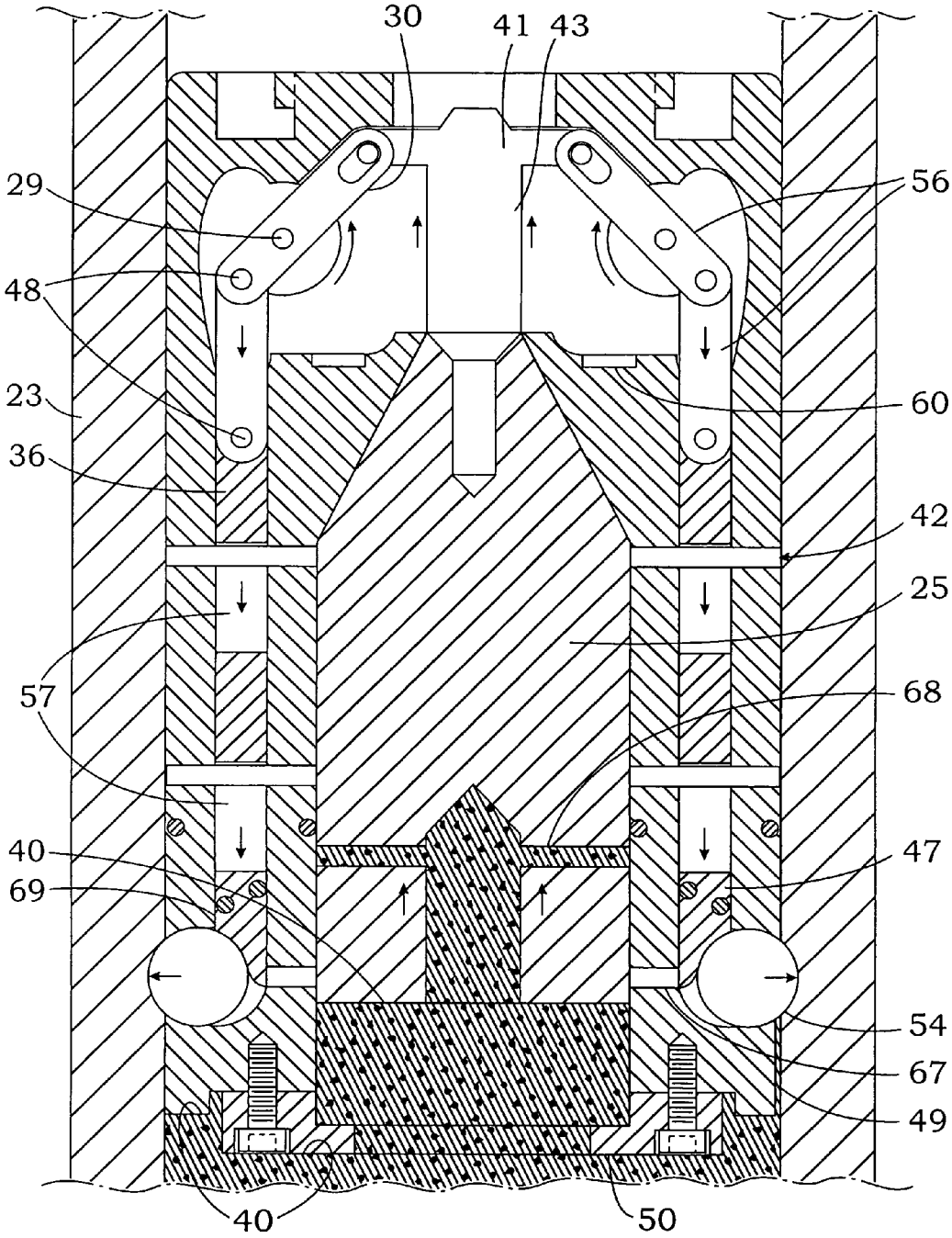
FIG. 4 shows the stop flow plug in the full stop position engaged against the structure that captures the valve. It also shows all the oil/gas leakage paths as well as the passages blocked
Figure 5:
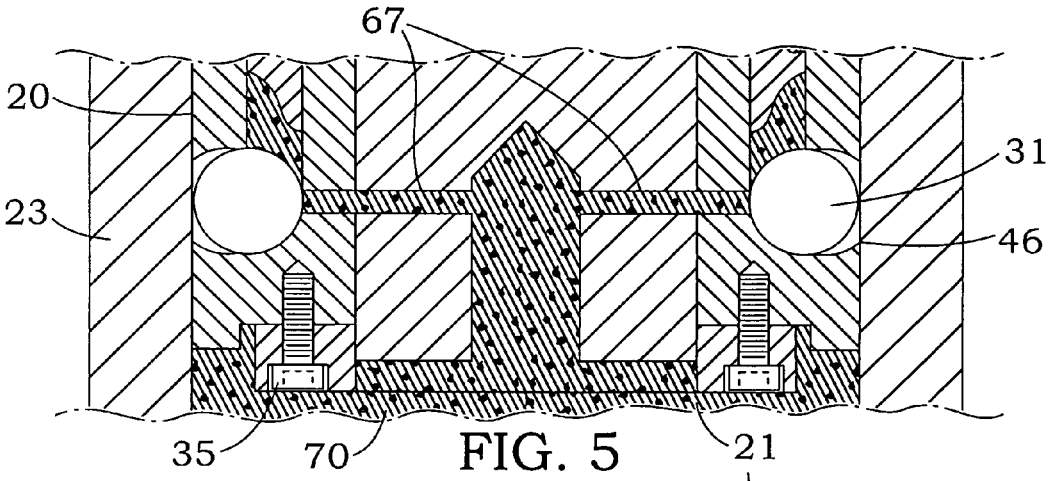
FIG. 5 shows the oil coming up from the well and going through a passage in the stop flow plug to contact the ball at its center, ready to drive pressure to force the balls into lock position in the riser pipe in order to stop the oil already in the passage.
Figure 6:
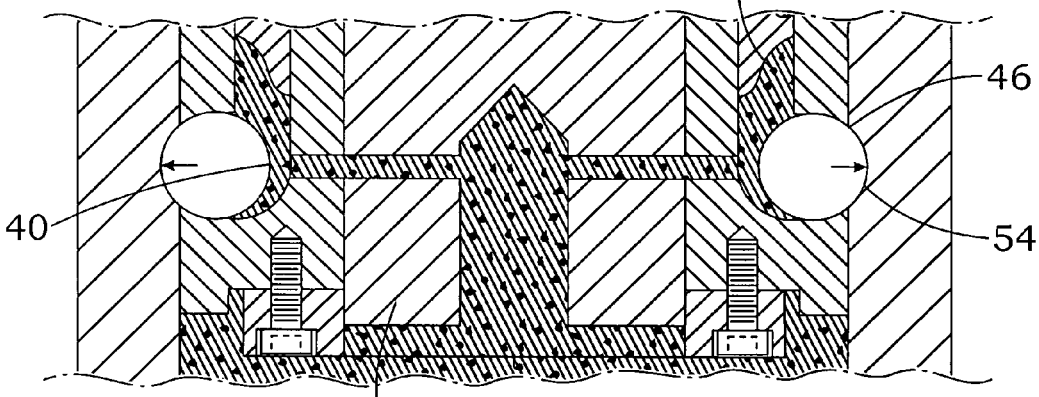
FIG. 6 shows how the internal pressure is used to drive the balls into the brinnel pockets in the riser pipe.
Figure 7:
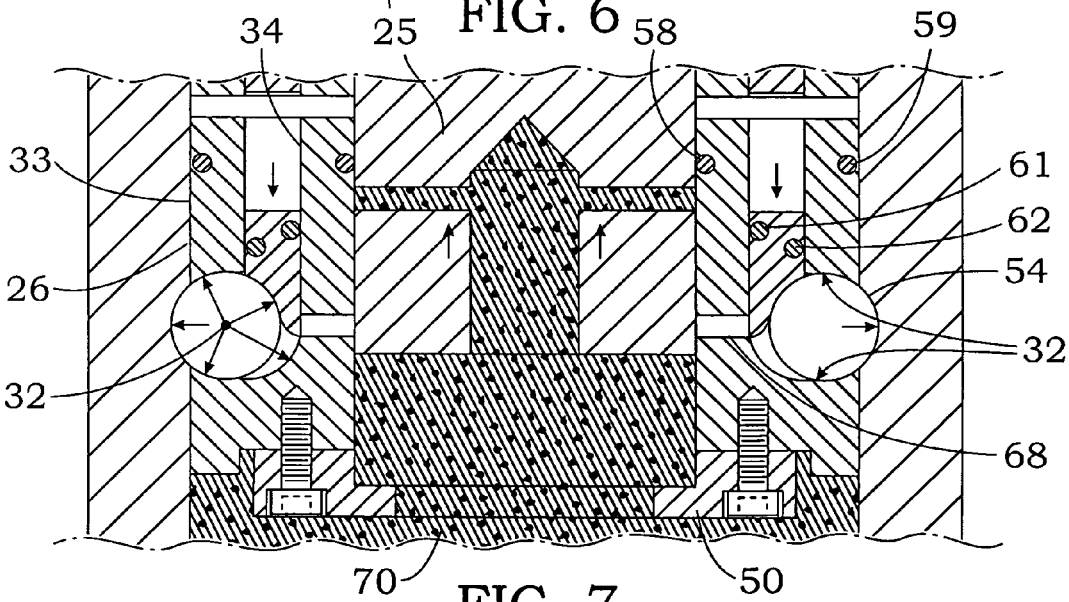
FIG. 7 shows all of the leakage sealed off by means of the O-rings (58, 59, 61, 62), how the two oil passages (67) flowing through the plug are cut off. All the wedges on the end of the sliding bar are driven downward and pushing against the back side of the balls and forcing them to stay indented in their retention pocket.

The instant invention is an oil retention system designed to be inserted into the riser pipe and moved downward by the use of the extension post of the drill string engagement tool (22), at the ocean surface on the drill ship, platform or operating unit. The invention provides a means for plugging the well riser pipe (23) with an oil/gas riser containment valve (20) which has on its outside structure (66) short vertical grooves (49) to be attached to the end of the drill string engagement tool (22) and inserted down the riser pipe (23), and it releases a sealing stop flow plug (25) to stop the flow of oil/gas (21) coming up the riser pipe from the newly drilled well. This riser containment valve (20) is driven to the close position by the internal pressure within the riser pipe (23). This means that the containment valve (20) can operate and shut off the pressure anywhere down the riser pipe (23), as desired. The containment valve (20) engages the end of the drill string tool (22) and connects to the tool with two tool engagement connection lugs (28) that interlock with two mating key drill string attachment pockets (44) on the containment valve (20), and by rotation engage the tool engagement connection lugs and lock them together to permit the drill string engagement tool to hold the valve assembly (24) attaching and releasing the containment valve (20) by rotation. At the same end of the drill string engagement tool (22) there is a tool extension post (27) that extends down into the valve assembly (24) and bears against the riser containment valve (20). This extension post (27) holds the containment valve (20) down to a position where oil/gas can pass through the containment valve (20) and up through the drill string engagement tool (22). When the drill string extension tool (22) is engaged with the containment valve (20), the containment valve is held open for oil passage through, and the tool extension post (27) provides the counter active force to hold the stop flow plug (25) open against the well excessive pressure while moving the stop flow plug (25) to an upward location and close the containment valve. When the riser pipe (23) extends into the containment valve (20) with the tool extension post (27), the containment valve permits the oil pressure in the riser below the containment valve (20) to push and drive the stop flow plug (25) upward in the containment valve (20) with the pressure encountered within the well to cut off the oil flow through the containment valve (20).

The stop flow plug (25) interfaces with the drill string engagement tool to close off this oil flow in the well. The stop flow plug (25) is guided to open and close positions by sliding on guide rail surfaces (33 & 34) in the valve. The stop flow plug (25) is a heavy steel machined plug that responds to the well's intensive internal pressure and functions as a pressure operated piston as it is driven and positioned in either open or sealed closed location. The nose of the stop flow plug is coned shaped (55) and it matches with a cone shaped cavity in the valve structure. On closure, the stop flow plug engages with this structure cavity to stop all oil/gas flow and all oil passages are blocked (68).

This oil retention system provides a means for interlocking the stop flow plug (25) to the inside surface of the riser pipe (23). This is achieved by a family of high strength CRES spherical steel or equivalent ball bearings (31) that are contained and trapped in the containment valve (20) and released to engage the riser pipe (23) by actuation of the drill string tool. The balls are retained in their operating locations by projecting lips (46) within the valve housing structure (26), as the containment valve (20) extended downward into the riser pipe (23). The ball bearings (31) are free to rotate as the containment valve (20) is inserted down in the riser pipe (23), on the open end of the drill string tool (22) and lowered down the inner side wall of the riser pipe (69). When the tool operator reaches the location where he wishes to stop all oil/gas flow in the riser pipe, by rotation of the drill string tool (22) he releases the balls in the valve, which then engage the sidewall of the riser by use of the existing oil pressure in the riser. After rotation of the drill string tool (22) with high pressure in the valve, the operator initiates the function of having the balls indent into the inner sidewalls of the riser (69), extracts the drill string tool (22), and this interlocks the valve into the riser inner sidewall (69) so that the high pressure in the containment valve (20) is stopped. The high pressure (70) against the ball bearings (31) forces them outward to brinnel against the riser pipe internal wall, (69) and indent spherical cavities (54) into this internal surface in a multiplicity of contact locations in an annular ring internally around the riser surface inner wall (69). In as much as the balls (31) are being driven into the riser inner sidewall and still being captured in the valve, they interlock the valve to the riser pipe. As there is a family of these balls (31) interlocking into the riser pipe (23), each of the balls locks and holds the containment valve (20) in the location that the drill string tool (22) has positioned it in the riser pipe (23).

As the indentation function is a circular concave contact point, implemented by the steel balls (31) Under intense pressure, there is no hole made, no fracture point incurred, no sharp edges encountered, and both the locking to the riser pipe internal side wall (69) and to the containment valve is only the engagement of each of the many locking contact engagement surfaces of the family of balls (31) with both the containment valve (20) and the riser pipe (23). And as the locking is accomplished with the steel, or equivalent, balls (31), there is no criticality of position for the balls engagement with the riser pipe internal wall (69) and no complex locking position or requirements for any lock release needs. Another feature of this type of engagement is that, when desired, the balls (31) can be easily removed and be able to disengage the riser pipe (23) by the repositioning of the drill string tool (22) to provide a means for the balls to be driven to the unlock position using the oil pressure in the riser pipe (23). For such purpose there are oil flow passages (67) in the containment valve that when the drill string tool (22) is raised upward in the riser pipe (23), additional space is provided to the balls (31) for release movement under the intense well pressure, and when disengaged, the containment valve can be released from the riser pipe (23). The external oil pressure is channeled to the lower surface of the balls to drive them out of their indented cavities (54). Oil pressure drives the stop flow plug (25) to this cut off position and continues to hold the plug and maintain it in the containment position.

An important feature of the invention is that variations of oil pressure cannot affect the oil flow plug's position in the containment valve (20). The stop flow plug (25) by contact of mating coned shaped surfaces (37) in the containment valve (20) can stop all the oil and gas flow through the containment valve. The oil/gas containment valve permits oil flow through the valve while it is being lowered down the riser pipe. This valve is held open for oil passage with a tool extension post (27). This is done to aid the operator on inserting and implementing passage of the valve down the riser pipe against intense pressures emitting up the riser from the new well. At the location where the oil containment valve (20) has been placed, the riser drill string tool (22) is rotated a quarter turn and releases the stop flow plug (25), and with the contained pressure in the riser pipe, provides the means to move the plug in the valve to the stop flow position.

The pressure against the base surface (53) of the plug provides the means to stop all flow through the containment valve. This intense pressure being applied against the base surface of the plug to seal the stoppage flow, at the same time, is exerting intense pressure against each ball of the family of balls (31) captured in the retention valve (20). With this internal pressure, each of the balls functions as a single point separate contact, but as pressure is driving the balls outward, the contact point brinnels outward on the riser internal sidewall (69). The indented cavities (54) enlarge, and each of the balls of the unit engages, entraps and locks itself in the sidewall indented pocket between the riser pipe and the ball retention cage (32). When the tool extension post (27) is rotated counter clockwise, all of the balls lock the containment valve in position. The locking load and the holding force of the oil/gas pressure in the well is shared equally by each of the balls engagement to the riser pipe As the drill string tool assembly is removed from the riser containment valve, the internal intense oil pressure in the riser pipe (23) drives the stop flow plug (25) upward in the valve assembly and the stop flow plug moves up hard against the cone shape surfaces (37) in the valve housing structure (26). The high pressure within the well against the base (53) of the stop flow plug (55) forces the nose cone shape surface to match the hard cone shape cavity of the valve assembly (24) and cuts off all flow through the containment valve. The projecting lips (46) control the depth the detent balls are driven into the riser and how these balls are captured by the ball cage (32) in the valve with surfaces in the structure of the valve (66), and provide the extension distance the balls are allowed to project beyond the valve structure. The oil/gas is stopped by the stop flow plug (25) and the passages (67) up through the well, where the oil/gas can flow to the surfaces, as well as leakage paths, are blocked between the riser walls and the valve housing structure (26). The stop flow retention assembly and its internal surface receive high pressure (40) from the well and that is applied on the close out plate (50) and its attachment screws (35) that retain the high pressure and provide a stop surface for the close out plate. The stop flow plug position in the valve's open gas flow-through-location is held securely by the valve post adaptor (39) pressing against the nose of the stop flow plug (25) This adaptor is provided at its upper and lower contact surfaces with a projecting alignment surface that mates and engages at its centering contact surface (51) with a centering cavity in the stop flow plug (25) to ensure complete centering of the load and pressure driving the plug upward. On the upper surface of the adaptor there is a similar centering feature to ensure complete alignment of the centering tool adaptor (52) with the drill string tool (52).

The extension post (27) attached to the drill string tool permits oil/gas to flow upward through it to the surface in order that the drill string tool does not have to work against the intense pressure in the well when the operator is inserting the containment valve (20) in the riser and lowering it down the riser. The containment valve (20) is provided with a secondary means to ensure that the engagement balls (31) fully indent into the riser inner sidewall (69). The system contains a mechanical linkage (56) that also drives the balls outward to indent into the wall of the riser and ensure engagement and locking of the valve to the riser. Attached to the valve post adaptor (39) are two projecting arms that extend outward and attach to a mechanical linkage (56) that provide a means for forcibly driving the attachment balls outward for locking the valve to the riser. This linkage is a simple cross bar (41) that has a cross bell crank arm (30) that engages a rotating link (63) that pivots around an axel pin (29) to permit the opposing end of the link to drive a connecting link (38) downward and provide the power to force the balls into their indented cavities (54). This rotating bell crank short arm (43) is attached to a connecting link (38) with linkage pins (48) to permit the rotating bell crank to rotate and be driven upward by the force and movement of the stop flow plug and it has been driven to closure by the intense pressure in the well. To ensure that the tool post adaptor (39) can move only vertically as it is being driven upward by the stop flow plug being driven to closure, the post adaptor (39) has a guide rod (64) on its lower end that projects downward into the stop flow plug and guides it and prevents it from rotating, causing a stoppage, and can move only in a vertical straight line upward and in a down direction. This guide rod inhibits the cross bar adaptor (41) from tilting and preventing the linkage on opposite sides from misaligning and having one linkage or the other getting and receiving an unbalance load. It forces each side mechanism to work in unison together. The connecting link (38) attached to the short arm (43) of the bell crank (30) drives a slide bar extension (36) that is guided on one side by a guide rail inner surface (34) and a guide rail outer surface (33) that is a part of the stop flow plug structure (65). The slide bar extends downward and has attached to its lower end a hardened steel ball wedge (47) that when driven downward by the force of the stop flow plug seating into its closure structure applies intense force on the ball wedge to drive the ball outward into their indented cavities (54). The slide bar (36) can move freely up and down as needed driven by the bell crank short arm (43) and is captured between the stop flow plug internal structure (65) and the outer containment valve housing structure (26). A set of guide rail capture pins (42) position and hold the stop flow plug valve inner structure (45) to the valve housing structure (26). The slide bar contains slide bar slots (57) that control the movement and travel distance of the slide bar and the outer valve housing structure (26). A set of guide rail capture pins (42) position and hold the stop flow plug inner structure (45) to the valve housing structure (66). The slide bar wedge contains O-rings (61 & 62) to seal any linkage of oil/gas up the cavity that the slide bar moves through. In addition, the structure that folds the stop flow plug also contains an O-ring (58) and the containment valve structure also has an O-ring (59) to stop oil/gas leakage between the outer valve housing and the riser. The oil/gas flow passages (67) from the base of the valve to the retention balls provide how the high pressure is directed to the CG of the balls and drives them into the indented cavities (54) in the riser wall. On oil flow stoppage all of these oil passages are blocked (68).

The containment valve contains a series of short vertical grooves (49) on its outside structure. When the valve is installed in the riser, at the end of the drilling function, and it is desired to remove the valve from the riser, and to let the oil/gas flow again, the operator can then detach the tool extension post adaptor (39) and release the valve retention system from the riser by retraction of the riser engagement balls. These vertical grooves aid the retraction of the balls from the valve structure by applying oil pressure on the lower surface of the balls to dislodge them from the indented riser cavities (54). This, again, utilizes the well's pressure to stop the oil/gas flow and at the same time, ensures positive engagement with the riser.

Therefore, as fully described herein, instead of contending with the internal pressure in the well, such pressure is the driving force of the present oil retention system.

The valve housing structure (26) contains the location of one or more electronic sensors (60) that enables the operator up in the drill ship or platform to monitor and control the positioning of the containment valve (20) and its internal stop flow plug (25) position during operation. In addition, the operator controls the procedure and management of placing and locking the valve into the riser. This sensor, or sensors provide a means of monitoring all functions in the stop flow system installation and operation.

| LIST OF PARTS | |
|---|---|
| 20 | Riser containment valve |
| 21 | Flow of oil/gas |
| 22 | Drill string engagement tool |
| 23 | Riser pipe |
| 24 | Valve assembly |
| 25 | Stop flow plug |
| 26 | Valve housing structure |
| 27 | Tool extension post |
| 28 | Tool engagement connection lugs |
| 29 | Pin, bell crank axle |
| 30 | Bell crank arm |
| 31 | Spherical ball bearing |
| 32 | Ball cage |
| 33 | Guide rail external surface |
| 34 | Guide rail internal surface |
| 35 | Cap screw |
| 36 | Bar, slide extension |
| 37 | Cone shaped cavity |
| 38 | Connection link |
| 39 | Valve post adaptor |
| 40 | High pressure surface |
| 41 | Cross bar |
| 42 | Pin, guide rail capture |
| 43 | Bell crank short arm |
| 44 | Drill string attachment pocket |
| 45 | Valve inner surface |
| 46 | Projecting lips |
| 47 | Ball wedge |
| 48 | Linkage pins |
| 49 | Vertical grooves |
| 50 | Plate close out |
| 51 | Centering contact surface |
| 52 | Centering tool adaptor |
| 53 | Plug base surface |
| 54 | Ball indented cavities |
| 55 | Nose cone shape surface |
| 56 | Mechanical linkage |
| 57 | Slide bar slots |
| 58 | O-ring seal, stop flow plug |
| 59 | O-ring seal, valve housing to riser |
| 60 | Electronic sensor |
| 61 | O-ring seal, inner wedge |
| 62 | O-ring seal, outer wedge |
| 63 | Bell crank rotating link |
| 64 | Guide rod |
| 65 | Stop flow plug structure |
| 66 | Outside structure of the valve |
| 67 | Oil flow passages |
| 68 | Blocked oil passages |
| 69 | Riser inner sidewall |
| 70 | High pressure |

We claim:

1. A containment valve assembly that provides a means for oil/gas control and stoppage up and through a well riser pipe, that utilizes the intense pressure in the well to activate a stop flow plug and drives this plug to the close position where it holds for containment of the oil/gas being driven to the surface, a) the containment valve assembly that is attached and mounted on the lower end of a drill string tool by engagement with recess pockets holding the containment valve for extension down inside of the well riser pipe, b) an extension post that is attached to the end of the drill string tool, that provides a means for extending and holding down the stop flow plug in an open oil/gas flow location where intense well pressure is driving the stop flow plug to a close position, c) the stop flow plug that contains a coned nose shape that matches a coned shaped cavity in an inner guide rail support structure that guides the plug movement upward to a complete stop flow location, d) the stop flow plug that operates as a piston with intense pressure from the oil/gas in the riser pipe driving the plug upward with the escaping oil/gas in the riser pushing against the plug's base surface, e) the stop flow plug that contains passages at its base to funnel oil/gas under intense pressure to an adjacent means for controlling the attachment of the valve to the inside surface of the riser pipe, f) the stop flow plug that contains a means for alignment control in its nose shape to accept centering contact of the extension tool and its extension post to ensure alignment of the nose cone shape with the cavity's cone shape on closure, g) the stop flow plug of mass and length that can move up and down on the internal guide rail surface without constraint, and when moved to an upward flow close location the exchange in location can close off the oil/gas intense flow through the valve and up the riser pipe, as well as close off all flow to the adjacent mechanism, h) the stop flow plug that is captured in the valve with a close out plate at its base that aligns to internal guide rail surfaces and accepts intense well pressure in compression, whereas the attachment fasteners receive none of the intense pressure utilized for flow control and capture, i) the stop flow plug whose internal guide rail is attached to the valve's outer structure with structural guide rail high strength capture pins that position and control operating freedom of movement of the stop flow plug, and retention of the cone cavity structure that receives and accepts intense pressure from the oil/gas flow through the valve.

2. A mechanical linkage assembly that provides the means for engagement and locking of a stop flow oil/gas containment valve to the internal surface of an oil/gas riser pipe and utilizes the intense pressure within the riser pipe to motivate a stop flow plug and its connecting linkage for engagement and retention of the valve in the riser pipe, a) the mechanical linkage assembly that utilizes a family of high strength indented spherical balls within the containment valve to indent cavities in the inner wall of the riser pipe to permit these same balls within these cavities to interconnect the valve to the riser pipe, as the balls within the cavities overlap the riser pipe with the valve, and prevent their separation, b) the mechanical linkage assembly that is attached to a cross bar that is a part of the oil/gas stop flow plug extension post, and provides the means for the interface of the assembly to the movement of the stop flow plug, c) the mechanical linkage that provides the means to ensure that the balls will indent into the wall of the riser pipe that had been previously indented in the riser pipe by means of intense pressure from the well, and funneled through passages in the oil/gas stop flow plug, d) the mechanical linkage connected to the extension post cross bar with a bell crank arm that rotates around an axel pivot pin and its rotation raises and lowers a sliding bar that is guided by an internal and external guide rail to interface with the indented spherical balls locking the valve to the riser pipe, e) the mechanical linkage that has attached to the lower end of the sliding bar a wedge that is used to forcibly drive the balls outward into the indented cavities in the riser pipe wall that were made by the intense pressure in the well, applying a load against the C.G. of the balls, and forcing them to indent into the riser pipe internal wall, f) the mechanical linkage that receives tremendous leverage from the stop flow plug to drive the guided sliding bar with the wedge attached, and forces the balls to roll outward into the indented pockets and hold them there with well oil pressure to ensure positive locking of the valve at its location in the well's riser pipe, g) the mechanical linkage that can release the balls from their engagement in the indented pockets, when activated by the stop flow plug movement to its open flow location and opening passage of the valve to oil/gas flow through the riser pipe, h) the mechanical linkage that utilizes the extension post attached to the drill string tool to hold open the oil/gas flow and permit the release of the containment valve from the riser inner wall, i) the mechanical linkage with the release of the stop flow plug to the open flow condition that has in the same operation extracted the wedge being held against the family of balls and permitted the balls to be extracted from the indented pockets when the drill string tool operator initiates retraction of the valve from the riser pipe, j) the mechanical linkage which contains in the valve containment structure one or more electronic sensors that transmit data up through the drill string tool to operators' displays and control centers.

* * * * *